US005129349A

United States Patent [19]

Glen

[11] Patent Number: 5,129,349

[45] Date of Patent: Jul. 14, 1992

[54] MOUNTING AND CONTROL OF OUTBOARD MOTORS

[75] Inventor: Robert D. Glen, Oxford, United Kingdom

[73] Assignee: E. P. Barrus, United Kingdom

[21] Appl. No.: 494,112

[22] Filed: Mar. 14, 1990

[30] Foreign Application Priority Data

Mar. 16, 1989 [GB] United Kingdom ..... 8906064

[51] Int. Cl.[5] ..... B63B 17/00

[52] U.S. Cl. ..... 114/343; 114/355

[58] Field of Search ..... 248/640, 641; 114/343, 114/355, 356, 357, 358; 440/53

[56] References Cited

U.S. PATENT DOCUMENTS 3,033,153 5/1962 Nelson et al. ..... 248/641
4,723,928 2/1988 Riley ..... 440/900
4,784,074 11/1988 Michalak ..... 114/57

FOREIGN PATENT DOCUMENTS 2281873 3/1976 France .

*Primary Examiner*—Sherman D. Basinger
*Attorney, Agent, or Firm*—Andrus, Sceales, Starke & Sawall

[57] ABSTRACT

A vessel 1 has a transom 2 carrying a W-shaped (or two V-shaped) frames 3 symmetrically arranged about its median line. Thus varying sizes of outboard motors, mounted over the transom, for example in twos, can find equivalent arms of the frame 3 to abut against and are thus aligned and symmetrically mounted.

3 Claims, 1 Drawing Sheet

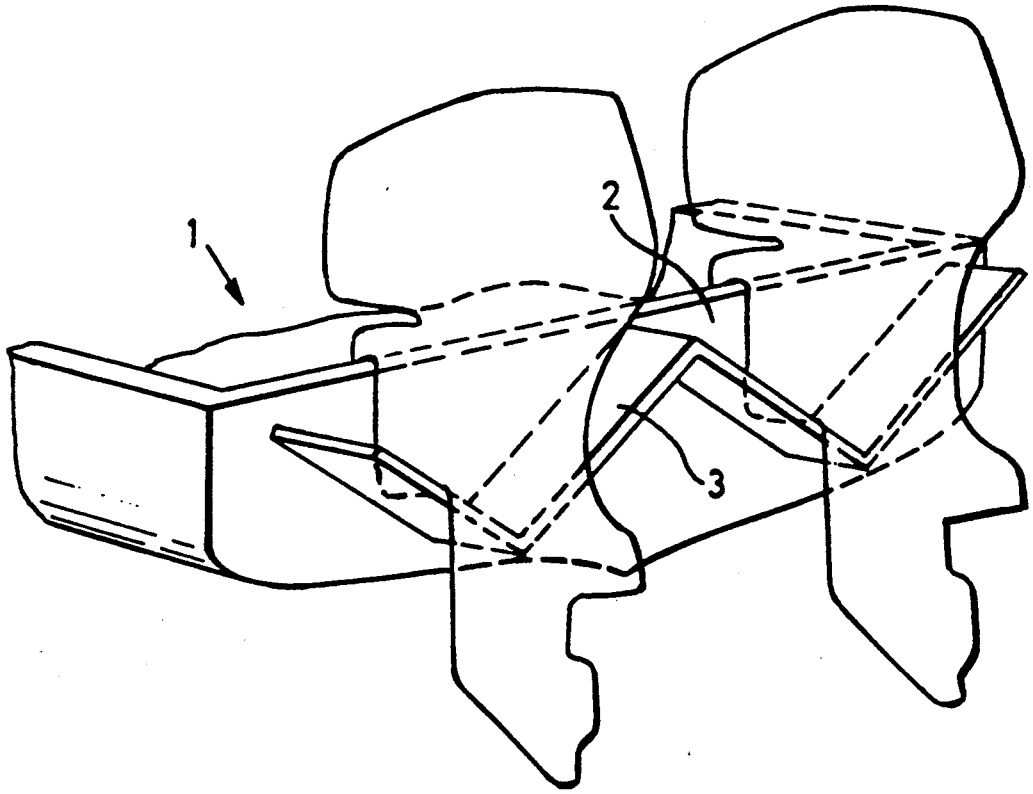
1
2
3

MOUNTING AND CONTROL OF OUTBOARD MOTORS

BACKGROUND OF THE INVENTION

This invention relates to outboard motors for making craft, and in particular to the alignment, steering, and control of two or more such motors.

It is of course well known to provide an outboard motor as a fitment to a marine craft. Typically this motor is bolted or clamped to the transom end provides motive power to a submerged propeller from an internal combustion engine at its upper part. Steering is effected by swinging the whole motor round a vertical pivoting axis using a forwardly-projecting steering tiller, and power to the motor is typically controlled by a twist grip upon this steering tiller connected to a conventional throttle.

It is also well known to mount two or more such motors side by side on a transom or transoms to provide increased power. The invention is particularly concerned with such arrangements. For convenience of description it will refer to a twin motor arrangement, it being understood however that similar arrangements for a triple or more motor mounting also fall within the scope of the invention as defined below.

When two or more motors are mounted side by side on a transom, some provisions must be made for convenient control of steering and of power of both motors. One known arrangement provide a detachable bar to connect the two tillers, so that movement of one tiller automatically involves movement of the other tiller. Typically, with such an arrangement a separate throttle control is envisaged.

Another known arrangement, as described in our earlier G.B. Patent No. 2031362 is to provide an additional single tiller. Such a tiller is connected to one of the motors, and protrudes forwardly essentially along the longitudinal median line of the vessel. The two motors are themselves interconnected by a tie rod, adjustable in length, between two motor mounting brackets. Push pull throttle cables extend from the additional tiller to each motor, and an optional gear change unit with connecting cables may be attached to one side of the additional tiller. In use, the individual tiller arms are folded up out of the way. The single additional tiller arm is used to control both steering and power.

Such an arrangement, whilst readily useable in that only one tiller protrudes forward from the motors, is somewhat elaborate and expensive. Accordingly, it has recently been proposed by the present Applicants to utilise a further type of interconnection, comprising two parts. One part is a rod interconnecting the steering brackets of the two motors, so that as one motor turns for steering the other motor turns with it. The other part is a rod connected to the twist portion of the relative throttle grips, so that as one twist portion turns to control the throttle the other twist portion also turns.

In this arrangement, instead of a single tiller there still remains both existing tillers, but either can be used to control both engines.

SUMMARY OF THE INVENTION

In a study of such twin motor systems, we have realised that joint control arrangements can vary in accordance with the size, cost, and intended use of the craft, and that moreover their effectiveness is also linked to the accuracy of alignment of the two motors and to the accessibility of other controls such as gear levers. The present invention, while being generally concerned with the control, and use of a twin motor system for marine craft, is particularly concerned with such areas of improvement.

The present invention is particularly concerned with mounting of twin or more motor systems.

When mounting twin motor systems at the rear of the craft and thereafter applying joint control systems which involve simultaneous turning of the motors about their respective axes, of the types discussed above, it is important that the motors should be accurately aligned. If not, will either be impossible to turn both motors since the relative attachment points of any interconnecting rod to each mount will vary in their distance apart as the two motors turn through the same angles, or the individual motors will turn through different angles as the joint assembly is turned, with consequent steering problems.

In one aspect the invention provides a mounting for facilitating location and alignment of two or more outboard motors fitted over a transom, comprising a frame extending rearwardly from the transom, the frame when viewed from astern having the shape of the letter W or having the shape of two adjacent letters V.

The assembly of two or more motors, and such a mounting constitutes another aspect of the invention.

BRIEF DESCRIPTION OF THE DRAWING

The invention will be further described with reference to the accompanying drawing which shows in three quarters view the transom of a light marine craft having attached thereto a mounting frame for outboard motors.

DETAILED DESCRIPTION OF THE PREFERRED EMBODIMENT

Vessel 1 has a transom 2, for mounting outboard motors. Conventionally an outboard motor is attached by means of mountings which fit over and are clamped to the upper edge of the transom, these mountings carrying a plate in relation to which the whole motor is pivoted about a vertical axis. The engine mountings are typically generally L-shaped, with one part of the L resting upon the top of the transom and the other part extending down inside, the vessel being bolted thereto or being pressed against the inboard of the transom by action of screw members operable by hand or by manual tools.

Where two such motors are mounted on the transom side by side, they are typically mounted one to either side of the median line of the vessel. There is a chance therefore that they are not symmetrically mounted. Also, if the transom is at all arcuate the motors may not be in full alignment as far as pivoting is concerned. In such a case they do not lend themselves in may instances to the type of joint control systems discussed above. Moreover, the problem is different in detail with different sized motors, since the geometry of the system and of the transom, in relative terms, differs in each case.

In order to overcome this problem, therefore, there is attached to the back of the transom an additional frame 3, symmetrically arranged in relation to the media line. In the embodiment shown, the frame is a steel mounting bracket which, viewed from astern, is of flattened W shape. (Alternatively, it could be arranged, as will become more apparent below, in the form of two V-shaped frames located side by side).

Such a protruding frame can be used for attachment of motors, since, in relation to the median line of the vessel there are a multiplicity of spaced but like abutment or attachment zones symmetrically arranged. Small motors, for example, can be mounted over the transom edge and, in relation to the internal descending arms of the W, at the same relative locations. Larger motors will be mounted over such an edge and also attached to or abutting the external descending arms. Wherever any two like motors are located they are both symmetrically arranged in relation to the mid-point, and aligned in relation to one another so that they are equipped for joint control e.g. by the methods as described above.

I claim:

1. A mounting assembly for facilitating location and alignment of two or more outboard motors fitted over a marine craft transom and attached thereto by motor mountings comprising a frame extending rearwardly from the transom, the frame when viewed from astern in a direction substantially perpendicular to the transom having arms defining the shape of an upright letter W or two adjacent upright letters V, said frame arranged symmetrically with respect to the centerline of the craft, and the arms of said letter W or said letters V defining abutments for the motors.

2. An assembly as claimed in claim 1 having two motors aligned by, and each abutting against, internal descending arms of the frame.

3. An assembly as claimed in claim 1 having two motors aligned by, and each abutting against, external descending arms of the frame.

* * * * *